United States Patent [19]

Kinsley, Jr.

[11] 4,421,794

[45] Dec. 20, 1983

[54] SOLVENT REMOVAL VIA CONTINUOUSLY SUPERHEATED HEAT TRANSFER MEDIUM

[75] Inventor: Homan B. Kinsley, Jr., Powhatan, Va.

[73] Assignee: James River Corporation, Richmond, Va.

[21] Appl. No.: 332,212

[22] Filed: Dec. 18, 1981

Related U.S. Application Data

[63] Continuation of Ser. No. 155,118, May 30, 1980, abandoned.

[51] Int. Cl.[3] ..... B05D 3/04

[52] U.S. Cl. ..... 427/377; 427/391; 427/345; 34/76; 34/23; 34/37; 8/149.3; 162/136; 162/165; 162/207

[58] Field of Search ..... 427/377, 378, 348, 335, 427/391; 34/76, 23, 37; 68/50; 8/149.3; 162/136, 165, 207; 118/61

[56] References Cited

U.S. PATENT DOCUMENTS

| | | | |
|---|---|---|---|
| 1,261,005 | 4/1918 | Barstow et al. | 34/37 |
| 2,174,170 | 9/1939 | Schweizer | 34/23 X |
| 2,298,803 | 10/1942 | Morris | 34/37 X |
| 2,565,152 | 8/1951 | Wachter et al. | 427/393.5 X |
| 2,590,850 | 4/1952 | Dungler | 34/23 |
| 2,627,667 | 2/1953 | Gillis | 34/23 |
| 2,760,410 | 8/1956 | Gillis | 34/23 X |
| 2,991,194 | 7/1961 | Cambron | 162/165 X |
| 3,089,250 | 5/1963 | Victor | 34/37 |
| 3,761,977 | 10/1973 | Rappoport | 8/149.3 |
| 4,242,808 | 1/1981 | Luthi | 34/23 |

OTHER PUBLICATIONS

Hunter, "The Use of Superheated Steam as a Drying Medium," *American Dyestuff Reporter*, Apr. 12, 1954, pp. 236–238.

Daane et al. "An Analysis of Air-Impingement Drying" *Tappi*, Jan. 1961, vol. 44, No. 1, pp. 73–80.

"Pulp-Drying Process Saves Energy, Cuts Market Pulp Production Costs," *Pulp and Paper*, Jun. 1980, pp. 186–187.

*Primary Examiner*—John D. Smith
*Assistant Examiner*—Bernard F. Plantz
*Attorney, Agent, or Firm*—Burns, Doane, Swecker and Mathis

[57] ABSTRACT

Non-aqueous solvents are removed from a substrate, e.g., paper, by contacting the substrate with a condensable, vaporous heat transfer medium that is in a superheated state, e.g., superheated steam, and maintaining said substrate in contact with said superheated heat transfer medium, while also maintaining said heat transfer medium in superheated state, for a period of time sufficient to effect removal of said non-aqueous liquid from said substrate without concomitant condensation of said superheated heat transfer medium thereon. The superheated heat transfer medium, as well as being the source of energy for evaporating the solvent, acts as a solvent vapor transport medium. Upon evaporation of the solvent, the solvent vapor-heat transfer medium mixture can be sent to a recovery zone to easily recover said solvent via condensation of the mixture and thereby avoid the discharge of said solvent vapors into the atmosphere.

22 Claims, 3 Drawing Figures

ROTAMETER
1
2
3
4
5
6
7
8
9
10
11
12
13
14

SOLVENT REMOVAL VIA CONTINUOUSLY SUPERHEATED HEAT TRANSFER MEDIUM

This application is a continuation of application Ser. No. 155,118, filed May 30, 1980, now abandoned.

BACKGROUND OF THE INVENTION

1. Field of the Invention

This invention relates to a novel process for removing a non-aqueous solvent from a substrate and thereafter recovering said solvent. In another aspect, this invention relates to a process for removing a non-aqueous solvent from coated or impregnated paper and a novel apparatus therefor.

2. Description of the Prior Art

The quest for a more efficient and effective process for removing non-aqueous solvents, e.g., organic solvents, from a substrate such as paper, cloth and non-woven or woven fabrics has been continuous. This is particularly true for areas of technology employing commercial processes involving the impregnation of a substrate with a resin wherein the resin is applied as a solution. The solution generally comprises a non-aqueous, organic solvent, removal and recovery of which is desirable for economic and environmental reasons.

The paper industry is one specific industry where the need for a more efficient and effective process for the removal of non-aqueous solvents is pronounced. More particularly, such need is especially pronounced in that portion of the paper industry pertaining to the impregnation of a paper substrate with phenol-formaldehyde resin. The phenol-formaldehyde resin is generally applied in an alcohol, e.g., methanol solution, with the methanol solvent being removed in a hot air oven. (Compare U.S. Pat. No. 2,991,194 issued to Cambron, July 4, 1961.)

The use of a hot air oven, however, has many disadvantages. For example, there is danger of combustion due to the presence of oxygen. To reduce this danger, the volume of air that is heated and employed is generally very large in order to provide sufficient dilution of the organic solvent to keep the concentration of the alcohol below a predetermined hazardous level.

Other disadvantages lie in the cost and the difficulty of recovering the alcohol solvent. Once the hot air has removed the solvent, the recovery of the alcohol from the hot air requires cooling the air and passing the cooled gas through a bed of activated charcoal on which the alcohol is adsorbed. The charcoal bed is then stripped of solvent by using steam, the steam-solvent vapor mixture is condensed, and finally, the steam-solvent mixture is distilled to recover water and solvent. However, because of the difficulties and expense involved in recovering the alcohol solvent by the foregoing, and other known methods of recovery, the alcohol vapors originating from the resin are generally exhausted to the atmosphere, or incinerated without recovery, in the hot air oven exhaust gas. This can produce a severe environmental impact.

Another disadvantage of using hot air to remove the organic solvent is that the presence of the oxygen, particularly in such large quantities, presents a favorable environment for the oxidation of the product. Also, the use of hot air requires heating large quantities of air, which can be wasteful and inefficient from an energy standpoint.

Other workers have employed steam as a heat source for evaporating organic solvents from substrates, but the heat supplied by the steam has always comprised some latent heat thereby resulting in the condensation of steam on the substrate. (Compare U.S. Pat. No. 1,261,005 issued to Barstow et al; U.S. Pat. No. 2,174,170 issued to Schweizer; U.S. Pat. No. 2,565,152 issued to Wachter et al; U.S. Pat. No. 2,590,850 issued to Dungler; and, U.S. Pat. No. 3,089,250 issued to Victor.)

Problems can arise with the condensation of steam on the substrate, however, in that the condensation can be very deleterious to a quality product, particularly if the substrate is a water sensitive substrate such as paper. For example, phenolic coated paper preferably has a moisture content of up to about 6% or less. If the moisture content increases much above 6%, e.g., to 10%, the paper will be too wet and will suffer in such properties as stiffness. Uncontrolled condensation of steam on a substrate, therefore, can be very detrimental to a product's properties.

In two other patents, U.S. Pat. No. 2,760,410 issued to Gillis and U.S. Pat. No. 3,761,977 issued to Rappoport, the use of steam for the removal of water is disclosed. In the Gillis patent, dry superheated steam is employed at pressures up to 60 psi to evaporate the water from newly formed paper. In the Rappoport patent, superheated steam at pressures in excess of 5 psig, and up to 115 psig, is employed to remove water from textile materials by directing the steam through the textile material. Neither of the patents, however, suggest or disclose a method for effectively and efficiently removing non-aqueous solvents from a substrate which avoid the aforementioned problems.

SUMMARY OF THE INVENTION

Accordingly, it is a major object of this invention to provide a novel process devoid of the aforementioned disadvantages.

Another object of this invention is to provide a method for thermally treating a substrate, such as paper, from which volatile substances of inflammable character are to be removed in such a manner that all danger of combustion is averted.

Another object of this invention is to provide a process for removing a solvent from a substrate whereby no moisture is added to the substrate.

Another object of this invention is to provide an energy efficient process for removing non-aqueous solvents from a substrate.

Yet another object of this invention is to provide a quick and efficient process for the removal and recovery of a solvent from a substrate without exhausting toxic substances to the atmosphere.

Another object of this invention is to treat an impregnated or coated substrate from which a non-aqueous, volatile solvent is to be removed with a heat transfer medium which also performs as the solvent vapor transport medium.

Still another object of this invention is to provide an easy and efficient method for recovering the organic solvent from a resin coated paper.

Briefly, the objectives of the present invention are achieved by employing a condensable, vaporous heat transfer medium that is in a superheated state, e.g., superheated steam. The superheated medium is contacted with a non-aqueous solvent containing substrate to thereby effect the removal of the solvent. The superheated medium in its superheated state is at such a level of superheat that said condensable medium possesses sufficient energy to remain in said superheated state while effecting removal of the solvent to thereby ensure that substantially none of the medium condenses upon the substrate. Upon evaporation of the non-aqueous solvent, the superheated medium and the solvent vapor are passed to recovery where the solvent and heat transfer medium are easily separated subsequent to condensation of the mixture.

In a preferred embodiment of the instant invention, superheated steam is employed to remove the alcohol solvent from a phenol-formaldehyde resin coated paper substrate. The steam that contacts the paper substrate is employed in a superheated state and at a temperature in the range of about 600° to about 900° F. (316°–482° C.).

In another aspect of the invention there is provided an apparatus for conducting the process which comprises an essentially closed treatment chamber; means for admitting and directing a continuous length of impregnated or coated flexible sheet material therethrough along an essentially planar path; means for admitting and directing a superheated heat transfer medium therethrough; and means for periodically interrupting and then redirecting the flow of said heat transfer medium along said path such as to continuously maintain the face surfaces of said flexible sheet material essentially free of surface deformations.

Other objects, features, and advantages of the present invention will become apparent to those skilled in the art upon a study of the disclosure, the appended claims and the drawings.

DETAILED DESCRIPTION OF THE INVENTION

Figure 1:
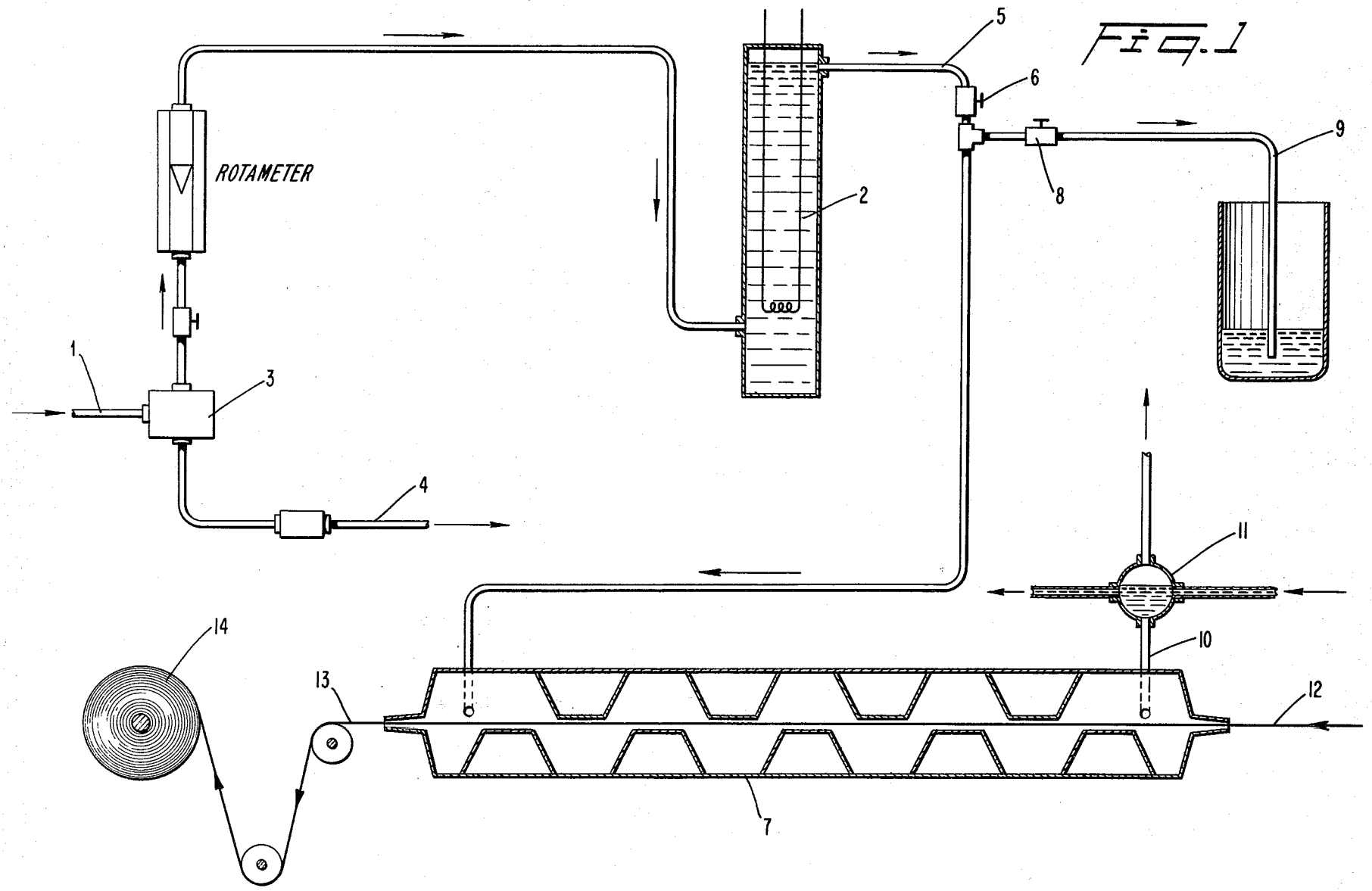
FIG. 1 is a general schematic depicting the use of superheated steam in accordance with the process of this invention and the apparatus employed therefor.

More particularly, the preferred condensable, vaporous heat transfer medium employed is superheated steam. Superheated steam is preferred primarily because it is abundantly available and is relatively inexpensive. Other suitable heat transfer mediums which are non-combustible and condensable, however, can also be used. For the sake of convenience, the following description of the invention will be rendered in terms of superheated steam as the heat transfer medium, but, the invention is not meant to be limited thereto.

The superheated steam employed in the process of the instant invention functions not only as a source of energy for evaporating the solvent, but also as the solvent vapor transport medium. The substrate containing the solvent, e.g., resin coated power, is contacted with steam being in superheated state. The energy of the superheated steam is sufficient to maintain said steam in superheated state throughout the contact so that the steam never cools to its saturated temperature and thus never condenses on the substrate. All the energy for heating the substrate, the substrate's coating, and the solvent, as well as for evaporating the solvent, is derived from the cooling of the superheated steam to a lower degree of superheatedness. The steam with this lower degree of superheat and the solvent vapors are then sent to recovery, e.g., a multi-plate still, or some other device for separation of the solvent and the water vapor.

Thus, the superheated steam is allowed to cool only to a lower degree of superheat so that it remains in a superheated state throughout the contacting and never becomes saturated steam. The product from which the solvent is removed, therefore, is not moistened by the process as it does not pick up any water due to condensation of the heat transfer medium. In order to insure this lack of condensation, the temperature to which the steam is heated need be such to place the steam in a superheated state and to ensure that when the steam exits from the oven, the steam is still in a superheated state. Thus, it is insured that latent heat is not used to evaporate the solvent and no condensation of the steam on the substrate occurs.

There is no critical maximum for the temperature of the steam employed. It is important, however, that the steam actually exist in a superheated state at the pressure employ and that said superheated state is maintained throughout the contact with the substrate.

Practical considerations should be weighed, however, when considering the temperature to be employed, e.g., problems with thermal expansion of the materials used in constructing the apparatus can occur if the steam employed is at too high a temperature.

Energy efficiency should also be a consideration when determining the appropriate temperature of the steam to be employed. The steam leaving the oven should not be at too high a level of superheat as this energy would just be wasted upon condensation of the steam in the recovery step. Ideally, the steam leaving the oven should be in a superheated state and at the lowest possible temperature to maintain said steam in the superheated state, e.g., 212°–215° F. This would allow for the most efficient use of energy. Thus, it is generally preferred that the exit temperature of the steam is at least 212° F.(100° C.) or above, and most preferably in the range of about 215° to 250° F.(102°–121° C.).

In order to provide sufficient energy to effect removal of a non-aqueous liquid from a substrate and ensure the maintenance of the superheated state throughout the contact without concomitant condensation of said superheated steam on the substrate, it is generally preferred that the inlet temperature of the superheated steam is in the range of about 400°–1500° F.(205°–875° C.), more preferably in the range of about 500°–1000° F. (260°–538° C.), and most preferably in the range of about 600° to 900° F.(315°–482° C.)

The length of time the substrate needs to be in contact with the superheated steam to achieve the results desired will depend on the temperature or energy content of the superheated steam. Generally, the higher the energy content of the superheated steam the lower the residence time required. Of course, one skilled in the art can easily vary the residence time by varying the speed of the paper substrate through the oven or by varying the length of the oven employed.

The amount of superheated steam employed is an effective amount, which is that amount necessary to effect the removal of solvent without condensation of the superheated medium occurring on the substrate. Generally, it has been found that about 3 to about 8 lbs of steam in a superheated state per hour for every lb of solvent, e.g., methanol, desired to be evaporated in one hour, and more preferably from about 4 to about 6 lbs of steam in a superheated state per hour for every lb of methanol to be evaporated per hour, when the inlet temperature of the superheated steam is in the range of about 600° to about 900° F., does an effective job of removing the solvent yet adding no moisture to the substrate from which the solvent is being removed.

Given the amount of non-aqueous solvent, e.g., methanol, one wishes to remove from a given amount of paper, and the desired (predetermined) temperatures of the steam entering and leaving the oven, one can easily calculate the appropriate amount of superheated steam necessary for removing the solvent without wetting the substrate. For example, if in one running hour the removal of 400 lbs of methanol from 1600 lbs of paper is desired, this would require heating the methanol and the paper to the temperature of the exit steam, e.g., a temperature of about 212° F.(100° C.) or above, which would require about 340,000 Btu per hour if said temperature is around 212° F. (100° C.). If the steam entering the system is employed at one psig pressure and 700° F.(371° C.) and leaves the system at about 212° F., it would lose about 233 Btu's per lb of steam employed. Therefore, 1,460 lbs of steam per hour, which is about 39,420 cubic feet of steam per hour, would be required to supply the necessary Btu's of heat necessary to raise the methanol and paper to the desired temperature. Given the size of the oven, e.g., a steam box or chamber 6 ft×1 ft×1 ft, 18.25 cubic feet of steam would be required to pass by one square foot of the web in one minute.

The steam to be superheated should also, in accordance with the objects of this invention, be dry. To this end, a steam separator can be employed prior to the superheater which heats the steam to the desired degree of superheatedness. The absence of moisture allows for a most efficient heating of the steam. If desired, the final moisture content of the substrate can be varied and controlled by varying the temperature of the steam. Generally, however, there is no desire for additional moisture and the only concern is the removal of the non-aqueous solvent without changing the moisture content of the substrate, particularly in the paper industry where only a low moisture content of 3 to 6% or less is acceptable for a superior product. Thus, dry steam in a superheated state is preferably employed.

One of the advantages of the process is that it can be and is preferably run at low pressures, e.g., from −5 to +5 psig, although higher pressures can be employed if so desired. It is preferred to run the process at these low pressures, however, in order to simplify the apparatus employed. If high pressures were used, a pressure vessel would have to be employed and there would be problems with the end seals and leakage of steam. These problems can be avoided by employing low pressures.

As indicated, a vacuum can even be employed in the oven or steam chamber. It is preferred, however, to keep a slight positive pressure, i.e., from 0 to about 5 lbs per square inch of pressure, to thereby prevent air from entering the oven and complicating matters with combustion problems. However, if the solvent to be removed is not inflammable, there is no objection to running the process under a slight negative pressure.

The process of the instant invention can be employed for the removal of any non-aqueous solvent. Recovery of the non-aqueous solvent from the superheated steam is complete and easy upon condensation thereof. This is true whether the non-aqueous, e.g., organic solvent, is miscible or immiscible with water. If the solvent is water-miscible, then distillation is employed to separate the solvent from the condensed steam in order to recover the solvent. If the solvent, however, is not miscible with water, then simple decantation can be employed to separate the solvent from the condensed steam. The solvent need not be miscible with water for the process to be effective as the superheated steam does not dissolve the solvent, rather, the superheated steam supplies heat for the evaporation of the solvent.

The process of the present invention also pertains to any substrate from which a non-aqueous liquid is to be removed. Generally, said non-aqueous liquid is a solvent employed to impregnate said substrate with a resin or the like. In this context, the present invention has particular applicability to a paper substrate which has been impregnated with a resin wherein the resin was applied in an organic solvent. More particularly, the instant invention has applicability to the removal of the alcohol solvent, i.e., methanol, employed in impregnating a paper substrate with a phenolic resin, such as that available from Pacific Resins and Chemicals, Inc., e.g., their resin identified by the trademark TYBON TM 975. Such phenolic resins are generally employed in the impregnation of a high bulk, low density paper substrate which can be employed ultimately as filter paper. The paper substrate generally has a high void volume of from about 60–90% by volume. The paper web substrate is contacted with the phenolic resin dissolved in the alcohol solvent to thereby impregnate the paper web. Then, in accordance with the instant invention, the alcohol solvent can be safely and efficiently removed by contacting the web with an effective amount of steam in a superheated state for a period of time sufficient to effect removal of the alcohol from the web without concomitant condensation of water vapor thereon.

The present invention, however, also finds application for the removal of non-aqueous liquids from cloth, non-woven and woven fabrics, polymer films or even metal.

Reference to the drawings will aid in describing specific embodiments of the instant invention and suitable apparatus employed therefor.

Referring to FIG. 1, steam from a steam source is carried via conduit 1 to a superheater 2, wherein the steam is heated to its ultimate predetermined temperature and placed in superheated state. Any conventional superheater can be employed which will heat the steam to the desired temperature. An example of a suitable superheater is a 24 kilowatt electric superheater. Optionally, a steam separator 3 can be employed to separate any water or moisture that the steam contains. Separated water can be removed via conduit 4. Removal of the moisture from the steam increases the efficiency of the steam superheater as it takes a great deal of additional energy to convert water into steam rather than just heating the steam to its ultimate temperature. The use of a steam separator is also preferred to insure the use of dry superheater steam, i.e., containing no moisture.

Superheated steam exits from the superheater via a conduit 5 and through a throttling valve 6, used to control the pressure of the steam, into the oven 7. It is also preferred that a safety valve 8 is employed in case the pressure of the steam becomes too great. The steam can pass through the safety valve via conduit 9 to a tank of water in order to condense any excess steam. Also, although the drawing shows steam entering the oven on one side of the paper substrate, if desired, the steam can be introduced into the oven on both side of the paper substrate.

The oven 7 can comprise any vessel, chamber or structure known in the art capable of maintaining the steam or heat transfer medium atmosphere under the pressures employed. Of course, said structure should be insulated to obviate the problem of loss of heat to the surrounding environment to as great an extent as possible. In its simplest form, said oven need only be an insulated box with inlets and outlets for the steam and solvent containing substrate.

A commercial superheated steam oven would preferably be about 15–25, and most preferably about 20 feet long. The oven could also contain a carrier wire or grid to support the sheet. This grid should move about 5% faster than the paper to prevent a wire or support pattern mark on the sheet. It is also preferred that the sheet should enter and leave the open through a nip to prevent steam losses with the nip rolls being non-stick, e.g., Teflon, coated to prevent sticking problems.

The steam passes through the oven 7 and exits via conduit 10 in mixture with the removed solvent vapors. The vaporous mixture is then condensed, for example, by adding cold water via conduit 11. The condensed water-solvent mixture can then be passed to solvent recovery. Solvent recovery can comprise either a simple decanting or a multi-plate distillation, depending on whether the removed solvent is water miscible or not. It is preferred that when the steam exits the oven at 10 that the steam leave the oven with a small amount of superheat to insure that no condensation thereof has occured in the oven. This insures that the moisture content of the paper substrate passing through the oven does not change, or is at least not increased to a deleterious amount.

The superheated steam can be passed through the oven countercurrently or co-currently to the flow of paper. In FIG. 1, the paper enters the oven at 12 and exits the oven at 13 upon being wound upon take-up roll 14 with the steam flowing countercurrent thereto. The countercurrent flow is preferred in the solvent removal step in order to contact the paper with the hottest steam just prior to exiting the oven.

The countercurrent or co-current flow scheme of the steam is particularly advantageous when removing non-aqueous liquids from a non-porous substrate. However, said set-up can also be employed most advantageously with a porous substrate, i.e., a substrate of sufficient porosity that the steam can pass easily therethrough.

Figure 2:
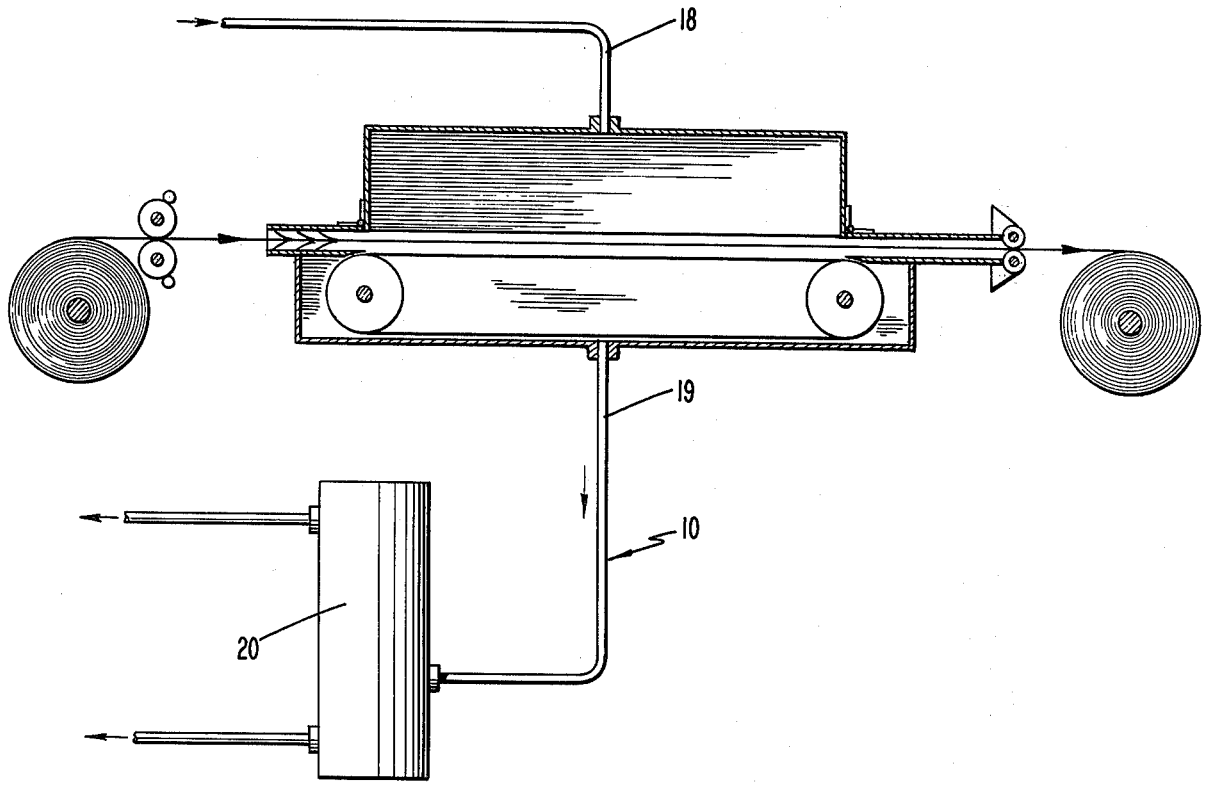
FIG. 2 depicts an alternative set-up which can be employed when removing and recovering a solvent from a porous web substrate.

Alternatively, if the substrate from which the non-aqueous liquid is being removed is porous, the oven set-up depicted in FIG. 2 can be employed if so desired. Referring to FIG. 2, steam enters the oven at 18 and exits on the other side 19 of the porous substrate. The superheated steam-solvent vapor mixture then passes via conduit 10 to solvent recovery 20.

Figure 3:
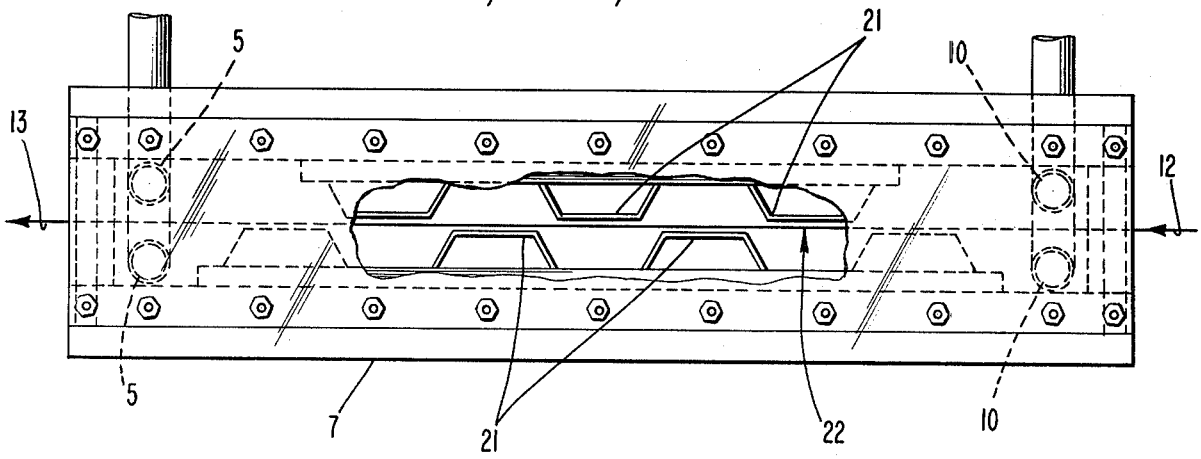
FIG. 3 is a schematic of a preferred embodiment of the instant invention with respect to the internal structure of the superheated steam oven.

Referring to FIG. 3, a preferred, novel internal structure of the oven is shown. The internal structure of the oven 7 comprises steam deflector vanes 21 between which a substrate 22 is passed. The deflector vanes 21 are means for periodically interrupting and then redirecting the flow of the heat transfer medium to effectively maintain the face surfaces of the substrate essentially free from deformation. The superheated steam enters the oven 7 via conduit 5 and exits via 10, while the paper substrate enters at 12 and exits at 13. If desired, the steam can also enter and exit the chamber in a cocurrent manner to the substrate.

As can be seen from the drawing, the steam deflector vanes 21 in the embodiment shown are baffles that are alternately positioned on the top and bottom of the oven, and preferably extending the entire width of said oven, so that each spacing between two upper baffles is positioned directly above a lower baffle and each spacing between two lower baffles is positioned directly below an upper baffle. Said spacings below or above the baffles are also preferably of equivalent size and shape as said baffle. This alternate positioning of the baffles stabilizes the paper substrate when being passed through the oven. Without said baffles, the paper would have a tendency to become unstable, violently twisted, and thus could easily wrinkle. The alternate positioning of the baffles also assures good steam-paper contact as the substrate moves through zones of alternating high and low velosity steam caused by said baffles.

The number of baffles employed is dependent upon the width of each baffle and the length of the oven. It is preferred, for practical considerations, that the baffles are of sufficient width that they are not knife-like and would thus adversely affect the substrate upon contact therewith. The shape of the baffles is preferably trapezoidal, although other shapes can be employed.

In order to further illustrate the present invention and the advantages thereof, the following specific examples are given, it being understood that same are intended only as illustrative and in nowise limitative. All parts and percentages in the examples and the remainder of the specification are by weight unless otherwise specified.

EXAMPLE 1

A phenolic resin coated paper wherein the phenolic resin was applied in a methanol solvent was passed through an oven and contacted with superheated steam. The phenolic resin comprised 20% of the total weight of resin and paper. The methanol solution in which the resin was added comprised 65% by weight methanol and about 35% by weight resin.

The oven dimensions were 6 ft/×1 ft.×1 ft. with about $\frac{3}{8}$ of an inch entrance and exit slots. The width of the paper was about 8 $\frac{7}{8}$ inches. The paper was a high bulk, low density paper of the type generally employed as filter paper.

The steam flow through the oven was 380 lbs of superheated steam per hour with the steam temperature at the inlet of the oven being about 430° F. The paper upon leaving the oven contained less than 0.1% methanol and comprised 88 to 96% solids. The following table summarizes the data obtained.

TABLE I

Steam Flow 380 lb/hr
Steam Temperature at Inlet to Oven 433° F.

| | Mass Flow Rates Into | | | Methanol Content Of Paper, %* | |
|---|---|---|---|---|---|
| | Sheet Speed | Oven, lb/hr | | Entering | |
| Run | ft/min | Paper | Methanol | Oven | Leaving Oven |
| 1 | 40 | 83 | 47 | 36 | 0.054 |
| 2 | 40 | 83 | 47 | 36 | 0.031 |
| 3 | 50 | 108 | 47 | 30 | 0.056 |
| 4 | 60 | 130 | 47 | 27 | 0.058 |
| 5 | 80 | 173 | 54 | 24 | 0.064 |

TABLE I-continued

| Steam Flow 380 lb/hr Steam Temperature at Inlet to Oven 433° F. | | | | | |
|---|---|---|---|---|---|
| | Mass Flow Rates Into | | | Methanol Content Of Paper, %* | |
| | Sheet Speed | Oven, lb/hr | | Entering | |
| Run | ft/min | Paper | Methanol | Oven | Leaving Oven |
| 6 | 105 | 227 | 54 | 19 | 0.077 |

*Methanol Content = 100 (lbs Methanol/lbs Paper + lbs Methanol)

Although the methanol removal was adequate, the moisture level of the paper exiting from the oven, although acceptable, could be improved with higher steam temperatures. The problem was that wet steam was entering the superheater, therefore, the steam entering the oven had a low temperature of only 433° F.(223° C.). As a result, high moisture levels were observed in the paper substrates leaving the oven due to some condensation of the steam on the substrate.

Upon installation of a steam separator to thereby remove the moisture from the steam, the superheated steam temperatures obtained were above 500° F. and the steam maintained its superheated state throughout the contacting. The contact of the steam as above with the paper substrate thus resulted in a paper sheet leaving the oven with a moisture content will below 3% and a methanol content of even less than the 0.1% previously obtained.

EXAMPLE 2

The following calculated example compares the cost of removing and recovering methanol from a phenolic resin coated paper by the process of the instant invention, i.e., the use of an effective amount of superheated steam of sufficient energy such that no condensation thereof occurs, and by a conventional system in which hot air is used to remove the methanol and a carbon bed system for recovering the methanol. The steps that occur in each system are summarized below:

| Superheated Steam System | Carbon Bed Recovery System |
|---|---|
| Paper, alcohol and resin are fed into the superheated steam oven. Steam and alcohol vapor leave oven. Mixture is fed directly to a vapor fed multi-plate still. A small amount of additional steam is required. The alcohol is collected from the still. | Paper, alcohol and resin are fed into a conventional hot air oven. The air and alcohol vapor leaving the oven are cooled to below 100° F. The air is passed through one of two carbon beds. When one bed is saturated with alcohol the flow switches to the second carbon bed. The saturated carbon bed is stripped with steam. The steam and alcohol vapor from the bed are condensed and collected in a tank. The aqueous alcohol is fractionated in a liquid fed multi-plate still. Additional steam is required. |

The cost of these operations is summarized below with the basis of the calculation being the operating cost in $/Ton methanol recovered.

| Operation | Carbon Bed |
|---|---|
| Energy Cost for Conventional Hot Air Oven, lbs fuel oil | 53 |
| Cooling of Oven Effluent | 1 |
| Steam to Strip Carbon Bed $2.30/1000 lb steam | 23 |
| Cooling Water to Condense Steam & Alcohol Vapor from Bed | 3 |
| Steam For Distillation Column | 32 |
| Electricity for Pumps | 2 |
| Cooling Water for Distillation Column | 6 |
| | 120 |

| Operation | Superheated Steam |
|---|---|
| Steam Cost to Operate Oven | 18 |
| Energy Cost to Superheat Steam | 7 |
| Steam For Distillation Column | 9 |
| Cooling Water for Distillation Column | 4 |
| | 38 |

One can see that the cost to operate the steam system is lower than the cost required to operate the hot air oven. The reason for this is that the hot air oven wastes a large quantity of energy heating air while the steam system heats only alcohol, paper and resin. Furthermore, the steam required to operate the still in the carbon bed case is greater than the amount of steam required to operate the still in the steam system since the still is liquid fed in the carbon bed system and vapor fed in the steam system.

EXAMPLE 3

To demonstrate the amount of energy required in employing the process of the claimed invention, the following calculated example is given. The calculation concerns the steam and electrical energy required to produce one ton of product assuming that the resin content is 20% of the final product and that the resin solution employed to impregnate the paper substrate was 35% resin and 65% methanol solvent. Thus,

| | |
|---|---|
| One ton of produce contains | 1600 lbs paper |
| | 400 lbs resin |
| | 2000 lbs solids |
| Resin solution strength = 35% | |
| or if X = lbs resin plus alcohol | |
| 0.35 X = 400, X = 1150 lbs solution or 750 lbs methanol per ton of product | |
| lb MeOH per lb base = 0.47 | |
| ΔH to heat methanol from 70° F. to 149° F.: | |
| ΔH = (lbs of methanol) (Heat Cap.) (T) = (750) (0.6) (79) = | 35,550 |
| ΔH to evaporate methanol | |
| Δ = (lbs of methanol) (Latent Heat) = (750) (471.6) = | 353,700 |
| ΔH to heat methanol vapor to steam exit | |

-continued

| | | |
|---|---|---|
| temperature of 250° F.: | | |
| (750) (0.34) (101) = | 25,750 | |
| ΔH to heat paper and resin from 70° F. to 250° F. | | |
| (2000) (0.34) (180) = | 122,400 | |
| Total Btu's required | 537,400 | Btu/Ton |
| If steam at oven inlet is 650° F. at 15 psia | H = 1359 | Btu/lb |
| If steam at outlet to oven is 250° F. at 15 psia | H = 1169 | Btu/lb |
| thus, | ΔH = 190 | Btu/lb |

So that 537,400/190=2828 lbs steam/hour which is the amount of steam required to supply the necessary heat energy if the inlet steam is at about 650° F. and the outlet steam is at about 250° F.

If the steam source is saturated plant steam (about 212° F.) at a pressure of 130 psia, said steam would possess 1192 Btu/lb of steam. Electrical resistance heating to 662° F.(H=1359) would be required so that adiabatic expansion would yield the desired 650° F. The Btu's required for said heating are: 1359–1192=167 But/lb of steam. Thus, the total amount of electrical energy required for heating the steam to remove the solvent from one ton of paper would be (167)(2828)=472,350 Btu/Ton of paper or 138.3 KwHr/Ton of paper These calculations assume no energy or steam losses.

In summary, some of the advantages afforded by the instant invention are that problems of explosion, combustion, and oxidation are avoided by employing a non-oxidizing heat transfer medium. Due to the non-oxidative character of the heat transfer medium, higher temperatures can be reached without oxidation of the final product, e.g., 550° to 600° F. (315° C.) and higher. If such temperatures were approached in an air atmosphere, substrates such as paper would burst into flames. Also, heat transfer mediums such as superheated steam possess a greater heat transfer coefficient and a higher heat capacity than air. This results in the use of a smaller oven and in a more uniform transfer of heat. Thus, the present invention offers a more efficient process in comparison to the conventional hot air process.

The use of steam in a superheated state which maintains said superheated state throughout the solvent removal step so that no condensation occurs on the substrate also overcomes the disadvantage of the prior art use of latent heat in that the moisture content of the substrate need not be changed, particularly increased, by the process. A change in moisture of the substrate is particulrly deleterious in the paper industry where uncontrolled moisture can be disastrous to the physical properties of the paper.

The use of a condensable, vaporous heat transfer medium such as superheated steam is also advantageous with respect to the recovery of the non-aqueous solvent being removed. By employing a condensable heat transfer medium such as steam in a superheated state, substantially all of the solvent vapors can be recovered upon condensation of the heat transfer medium. Then, by simple distillation or decantation, the water can be separated from the solvent. This is particularly advantageous when the cost of the solvent to be recovered is economically significant, e.g., as in the case of methanol, and/or environmentally hazardous.

While the invention has been described in terms of various preferred embodiments, the skilled artisan will appreciate that various modifications, substitutions, omissions, and changes may be made without departing from the spirit thereof. Accordingly, it is intended that the scope of the present invention be limited solely by the scope of the following claims.

What is claimed:

1. A process for the removal of a non-aqueous liquid from a high bulk, low density, porous cellulosic substrate having a void volume of from about 60 to 90 percent which is essentially completely impregnated with said non-aqueous liquid, comprising contacting such substrate with an effective amount of a condensable, vaporous heat transfer medium which is in a superheated state, and maintaining said substrate in contact with said superheated transfer medium, while also maintaining said heat transfer medium in superheated state, for a period of time sufficient to effect removal of substantially all said non-aqueous liquid from said substrate without concomitant condensation of said superheated heat transfer medium thereon.

2. The process of claim 1 wherein said heat transfer medium is superheated steam.

3. The process of claim 2 wherein superheated steam in mixture with removed non-aqueous liquid is passed to separation to recover said liquid and said separation comprises decantation or distillation.

4. The process of claim 2 wherein said superheated steam is employed at a temperature in the range of about 500° to about 1,000° F. upon first contacting said substrate and is still in a superheated state when last contacting said substrate.

5. The process of claim 4 wherein said superheated steam is employed at a temperature in the range of about 600° to about 900° F.

6. The process of claim 4 or 5 wherein said contacting of the substrate with the superheated steam is conducted under pressure of about 5 psig or less.

7. The process of claim 4 wherein said substrate is a paper substrate coated with a phenolic resin and said non-aqueous liquid removed from said paper substrate is the organic solvent employed in impregnating the paper with the phenolic resin.

8. The process of claim 7 wherein said organic solvent is methanol.

9. The process of claim 8 wherein about 3 to about 8 lbs of superheated steam per hour are employed for every lb of methanol to be removed from the paper substrate and wherein said superheated steam is at a temperature in the range of about 600° to about 900° F. upon initial contact with said paper substrate.

10. The process of claim 9 wherein about 4 to about 6 lbs of superheated steam per hour are employed.

11. The process of claim 9 or 10 wherein the contacting of the substrate with the superheated steam is conducted under a pressure in the range of about −5 to about +5 psig.

12. The process of claim 2 wherein the amount of superheated steam employed is in the range of about 3 to about 8 lbs of superheated steam per hour for every lb of non-aqueous liquid to be removed.

13. The process of claim 2 wherein the amount of superheated steam employed is at least 3 lbs. of superheated steam for every lb. of non-aqueous liquid to be removed.

14. The process of claim 2 wherein the superheated steam passes through the porous cellulosic substrate.

15. The process of claim 1, wherein the non-aqueous liquid is methanol.

16. The process of claim 15, wherein the removal of methanol is such that the methanol content of the substrate is about 0.1% or less.

17. The process of claim 1, wherein the removal of the non-aqueous liquid is such that its content in the substrate is about 0.1% or less.

18. A process for impregnating a high bulk, porous paper substrate having a void volume of from about 60 to 90 percent with a resin which comprises (i) contacting said paper substrate with a solution comprising said resin dissolved in an organic solvent whereby the paper substrate becomes essentially completely impregnated therewith, and (ii) removing substantially all the organic solvent from the substrate by contacting said paper substrate with an effective amount of a condensable, vaporous heat transfer medium which is in a superheated state, and maintaining said paper substrate in contact with the superheated heat transfer medium, while maintaining said heat transfer medium in superheated state, for a period of time sufficient to effect said removal of said organic solvent without concomitant condensation of said superheated heat transfer medium on the paper substrate.

19. The process of claim 18 wherein said superheated heat transfer medium is superheated steam;

said resin is a phenolic resin;

said organic solvent is an alcohol; and said superheated steam is employed under a pressure in the range of about −5 to about +5 psig, at a temperature in the range of about 600° to 900° F. upon initial contact with the paper substrate, and in an amount in the range of about 3 to about 8 lbs of superheated steam per hour per lb of alcohol to be removed in said hour.

20. The process of claim 18, wherein the organic solvent is methanol.

21. The process of claim 19, wherein the alcohol is methanol.

22. The process of claim 21, wherein the removal of methanol is such that the methanol content of the paper substrate is about 0.1% or less.

* * * * *